US010023273B1

(12) United States Patent
Silveri, Sr.

(10) Patent No.: US 10,023,273 B1
(45) Date of Patent: Jul. 17, 2018

(54) BARGE AND ASSEMBLY METHOD

(71) Applicant: Michael Silveri, Sr., Pompano Beach, FL (US)

(72) Inventor: Michael Silveri, Sr., Pompano Beach, FL (US)

( * ) Notice: Subject to any disclaimer, the term of this patent is extended or adjusted under 35 U.S.C. 154(b) by 0 days.

(21) Appl. No.: 15/476,908

(22) Filed: Mar. 31, 2017

(51) Int. Cl.

| | |
|---|---|
| ***B63B 1/00*** | (2006.01) |
| ***B63B 35/28*** | (2006.01) |
| ***B63B 3/04*** | (2006.01) |
| ***B63B 3/26*** | (2006.01) |
| *B63B 3/14* | (2006.01) |

(52) U.S. Cl.
CPC ..... *B63B 35/28* (2013.01); *B63B 3/04* (2013.01); *B63B 3/26* (2013.01); *B63B 2003/145* (2013.01); *B63B 2701/12* (2013.01)

(58) Field of Classification Search
CPC ..... B63B 35/28; B63B 35/308
USPC ..... 405/7
See application file for complete search history.

(56) References Cited

U.S. PATENT DOCUMENTS

| | | | | |
|---|---|---|---|---|
| 4,007,700 | A * | 2/1977 | Haynes | B63B 35/28 114/74 T |
| 6,575,661 | B1 * | 6/2003 | Phillips | B63C 3/06 114/44 |
| 7,413,379 | B2 * | 8/2008 | Creel | B63C 1/10 114/55 |
| 2015/0158566 | A1 * | 6/2015 | Doig | B63C 3/06 405/7 |

* cited by examiner

*Primary Examiner* — Stephen P Avila
(74) *Attorney, Agent, or Firm* — Johnson & Martin, P.A.; James David Johnson

(57) ABSTRACT

A barge, a barge assembly system, and assembly method are provided for assembling a barge that is constructed in component pieces sized to be capable of shipping by road or railway from a first location to a second location adjacent to a body of water for assembly of the barge. The barge assembly system includes a portable assembly device having a variety of frame elements that, when assembled, produce a structure capable of supporting barge section components that are placed thereupon so that the barge may be assembled. The barge assembly system can also include a crane for lifting the barge section components onto a support surface of the portable assembly device.

15 Claims, 5 Drawing Sheets

BARGE AND ASSEMBLY METHOD

FIELD OF THE INVENTION

This invention relates to a floating barge and a method for assembling the same. More particularly, the invention relates to a floating barge on which a superstructure can be constructed and methods for remotely constructing the barge in pieces that can be transported and assembled next to a body of water.

BACKGROUND

The construction of ships, including barges, traditionally has been performed at sites adjacent to bodies of water, e.g., next to rivers, lakes, inlets, canals, and oceans. With the desirability of waterfront properties having increased for residential and recreational use and for use by the hotel and restaurant industries, the cost and value of waterfront property has also increased. In other instances, waterfront land may also be marked for environmental protection as sensitive or threatened habitats and ecosystems, which further reduces the availability of such land for industrial use.

A need exists for barge designs that may be constructed in locations that are not waterfront but which may be transported by road or railway to a waterfront location for assembly. A need also exists for an assembly system that may be transported from a first site to a second site for use in assembling such a barge next to a body of water.

SUMMARY

The invention relates to a barge is constructed in component pieces sized so as to be capable of shipping by road or railway from a first location to a second location adjacent to a body of water for assembly of the barge. The invention also relates to a barge assembly system and assembly method for assembling the barge. The barge assembly system includes a portable assembly device having a variety of frame elements that, when assembled, produce a structure capable of supporting barge section components that are placed thereupon so that the barge may be assembled. The frame elements include a series of base support members, a series of vertical support members attached to the series of base support members, a series of inclined members attached to the vertical support members, and a series of horizontal members attached to upper surfaces of the inclined members to create a support surface against which at least two barge section components can be rested for assembly of the barge. The barge assembly system can also include a crane for lifting the barge section components onto a support surface of the portable assembly device.

The barge provides an advantage over conventional barges in that it can be constructed in parts at a first location and the parts can be transported over land to a second location adjacent to a body of water. Similarly, the barge assembly system and associated method are also advantageous in that they allow several unassembled components of a barge to be transported from a first location and assembled at a second location that is adjacent to a body of water. This advantage is particularly important in the case of barges that are too large to be transported by truck or rail when assembled.

Accordingly, the invention features a barge system that includes a first barge section component and at least a second barge section component that is attachable to the first barge section component to assemble a barge, wherein each of the barge section components includes a watertight bulkhead compartment.

In another aspect, the invention can feature each of the barge section components being sized so as to be capable of transportation by a truck or train from a first location to a second location where the barge is to be assembled using the portable assembly device.

In another aspect, the invention can feature each of the barge section components including a central inner wall that divides each barge section into two watertight bulkhead compartments.

In another aspect, the invention can feature the first barge section component and at least a second barge section component being attached together using a portable assembly device.

In another aspect, the invention can feature the assembled barge supporting a superstructure constructed on its top surface.

In another aspect, the invention can feature the portable assembly device including at least two vertical support members, inclined members corresponding in number to the number of the at least two vertical support members, and at least two horizontal members. One inclined member is attached to each vertical support member, and each inclined member has an upper surface. Each horizontal member is attached to an upper surface of at least two of the inclined members to create a support surface against which the first barge section component and the at least second barge section component can be rested.

In another aspect, the invention can feature the portable assembly device further including a stop member connected to a bottom portion of the upper surface of at least one of the inclined members to catch and hold in place a bottom surface of the first barge section component rested onto the support surface of the portable assembly device.

The invention also features a barge assembly system that includes a portable assembly device for supporting at least two barge section components while they are attached together for assembly of a barge, wherein the portable assembly device includes frame elements that are separable for storage and transportation.

In another aspect, the invention can feature the frame elements of the portable assembly device include a series of base support members, a series of vertical support members, a series of inclined members, and a series of horizontal members. Each vertical support member is attached to a base support member of the series of base support members. Each inclined member comprises an upper surface. The series of horizontal members are attached to the upper surfaces of the inclined members to create a support surface against which the at least two barge section components are rested for assembly of the barge.

In another aspect, the invention can feature a stop member connected to a bottom portion of the upper surface of at least one of the inclined members to catch and hold in place a bottom surface of a first barge section component of the at least two barge section components that is rested onto the support surface of the portable assembly device.

In another aspect, the invention can feature the series of vertical support members including at least nine vertical support members so that at least three vertical support members are attached to each base support member of the series of base support members, and wherein the series of base support members includes at least three base support members.

In another aspect, the invention can feature the series of vertical support members being arranged in groups of at least three vertical support members that include a tall vertical support member, an intermediate vertical support member, and a short vertical support member. Each short vertical support member in each group is about one-half the height of each intermediate vertical support member, and each intermediate vertical support member is about one-half the height of each tall vertical support member.

In another aspect, the invention can feature at least one stabilizing member being attached to the tall vertical support members of the series of vertical support members to provide additional stability to a rear side of the portable assembly device.

In another aspect, the invention can feature the series of inclined members including at least three inclined members, wherein each inclined member is attached in a sloping orientation with a highest portion of each inclined member being oriented toward a rear side of the portable assembly device and a lowest portion of each inclined member being oriented toward a front side of the portable assembly device.

In another aspect, the invention can feature a bottom portion of each vertical support member of the series of vertical support members being attached to a top surface of a base support member of the series of base support members. A bottom surface of each inclined member of the series of inclined members is attached to a top portion of a vertical support member of the series of vertical support members, and a bottom surface of each horizontal member of the series of horizontal members is attached to a top surface of at least two inclined members of the series of inclined members.

In another aspect, the invention can feature a means for lifting at least two barge section components onto the portable assembly device for assembly of the barge.

In another aspect, the invention can feature the means for lifting being a crane for lifting the at least two barge section components onto the portable assembly device.

In another aspect, the invention can feature the portable assembly device being constructed from steel, aluminum, a non-ferrous metal, or a combination of two or more of the foregoing.

A method of the invention can be used for assembling a barge and includes the steps of: (a) building a first barge section component and at least a second barge section component at a first location; (b) transporting the first barge section component and the at least second barge section component to a second location; (c) lifting the first barge section onto a support surface of a portable assembly device, wherein the portable assembly device includes: a series of base support members; a series of vertical support members, wherein each vertical support member is attached to a base support member of the series of base support members; a series of inclined members attached to the vertical support members, wherein each inclined member includes an upper surface; and a series of horizontal members attached to the upper surfaces of the inclined members to create the support surface against which the at least two barge section components are rested for assembly; (d) lifting the at least second barge section component onto the support surface of the portable assembly device in a position that is superior to the first barge section component; and (e) attaching the first barge section component and the at least second barge section component together to assemble a barge.

Another method of the invention can include before steps (a), (b), or (c), the step of assembling the portable assembly device at the second location for use in assembling the barge.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
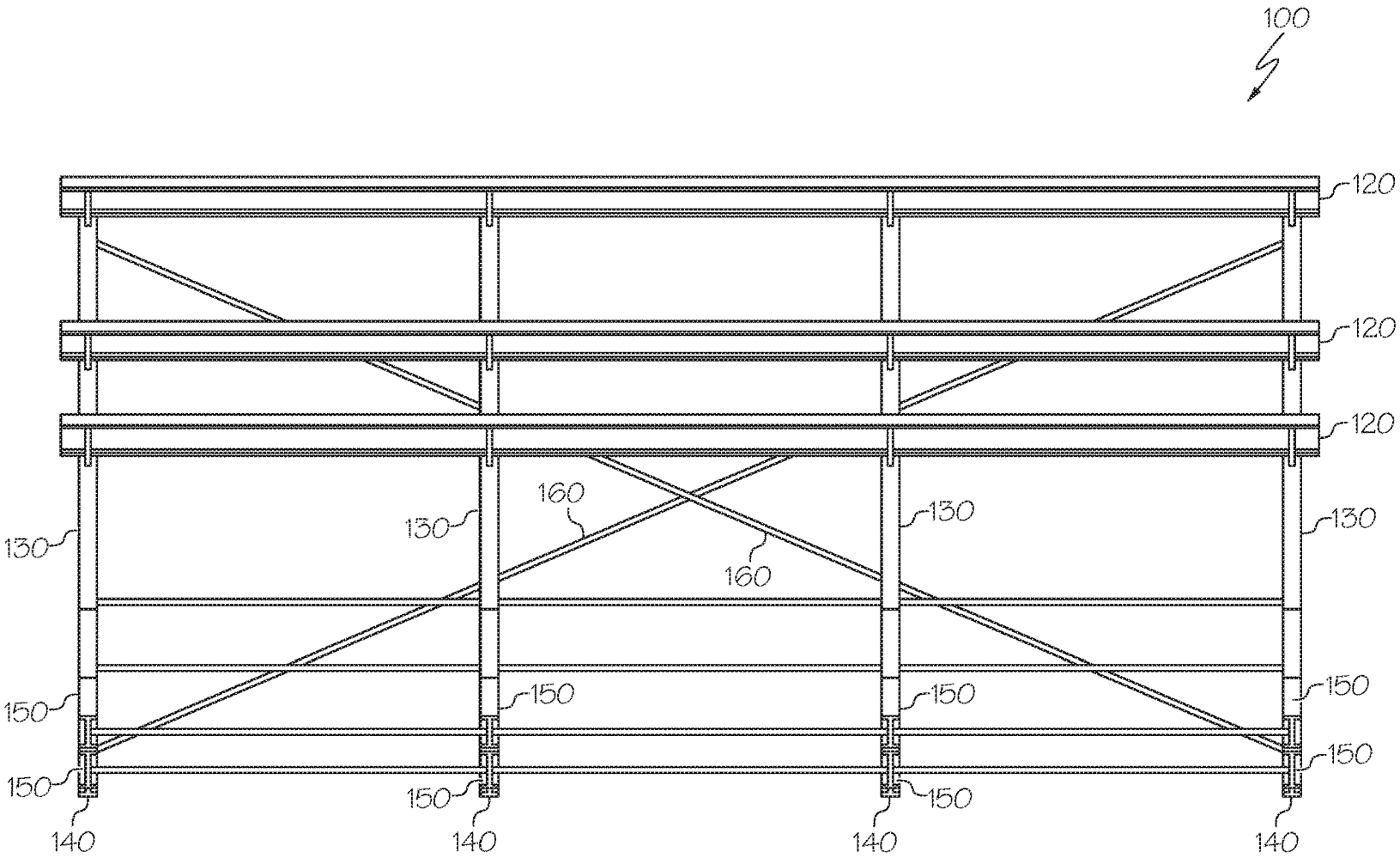
FIG. 1 is a front elevation view of a portable assembly device of a barge assembly system.
Figure 2:
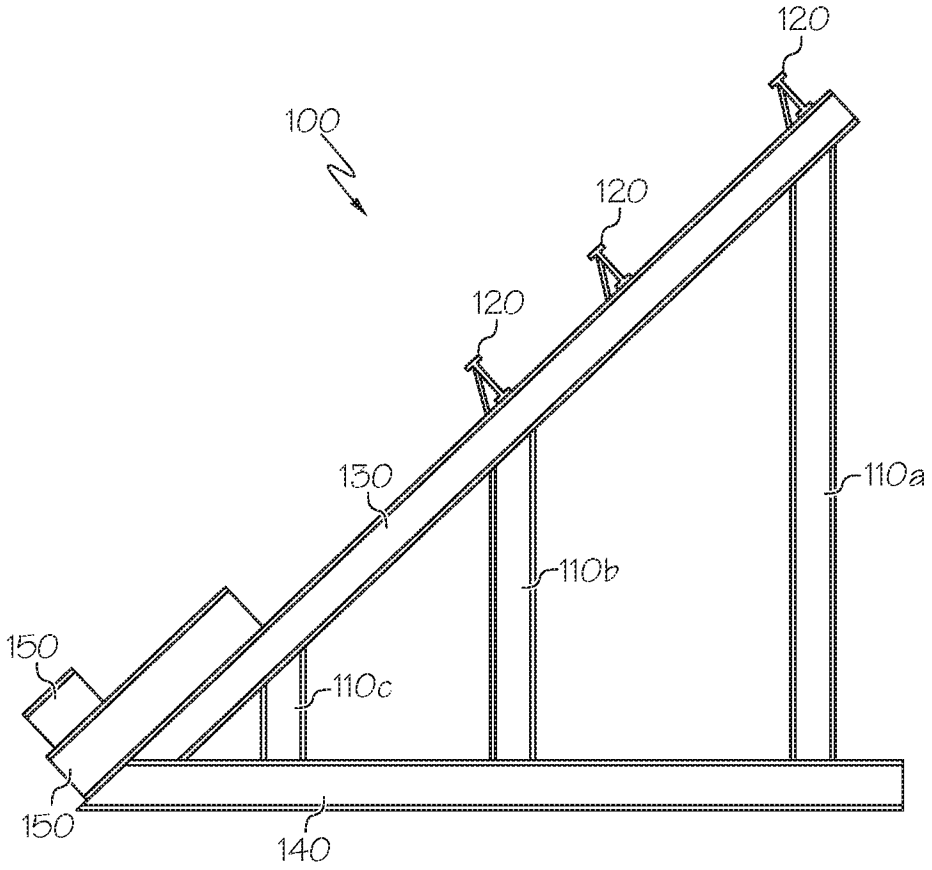
FIG. 2 is a side elevation view of the portable assembly device of FIG. 1.
Figure 3:
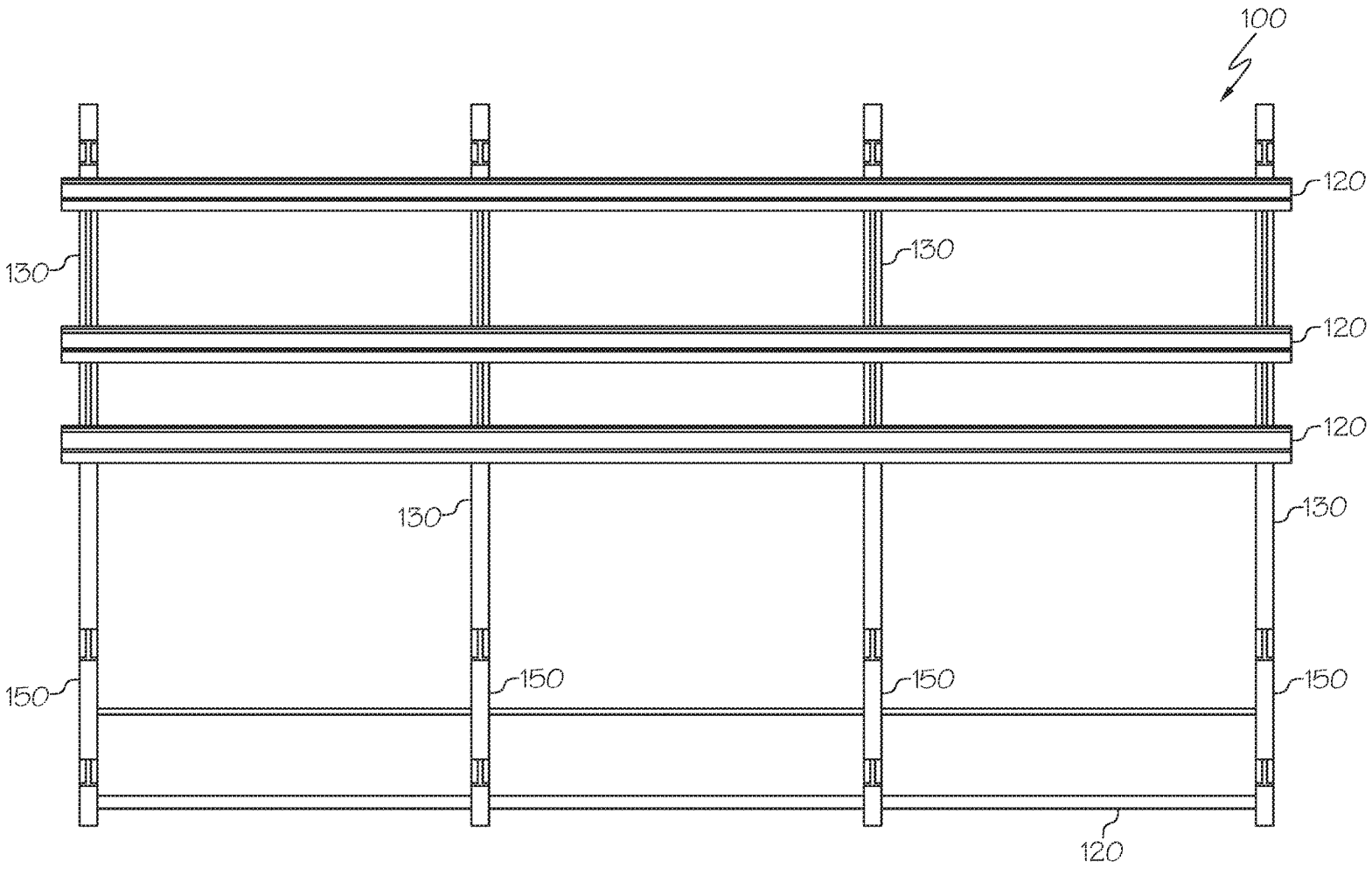
FIG. 3 is a top plan view of the portable assembly device of FIG. 1.
Figure 4:
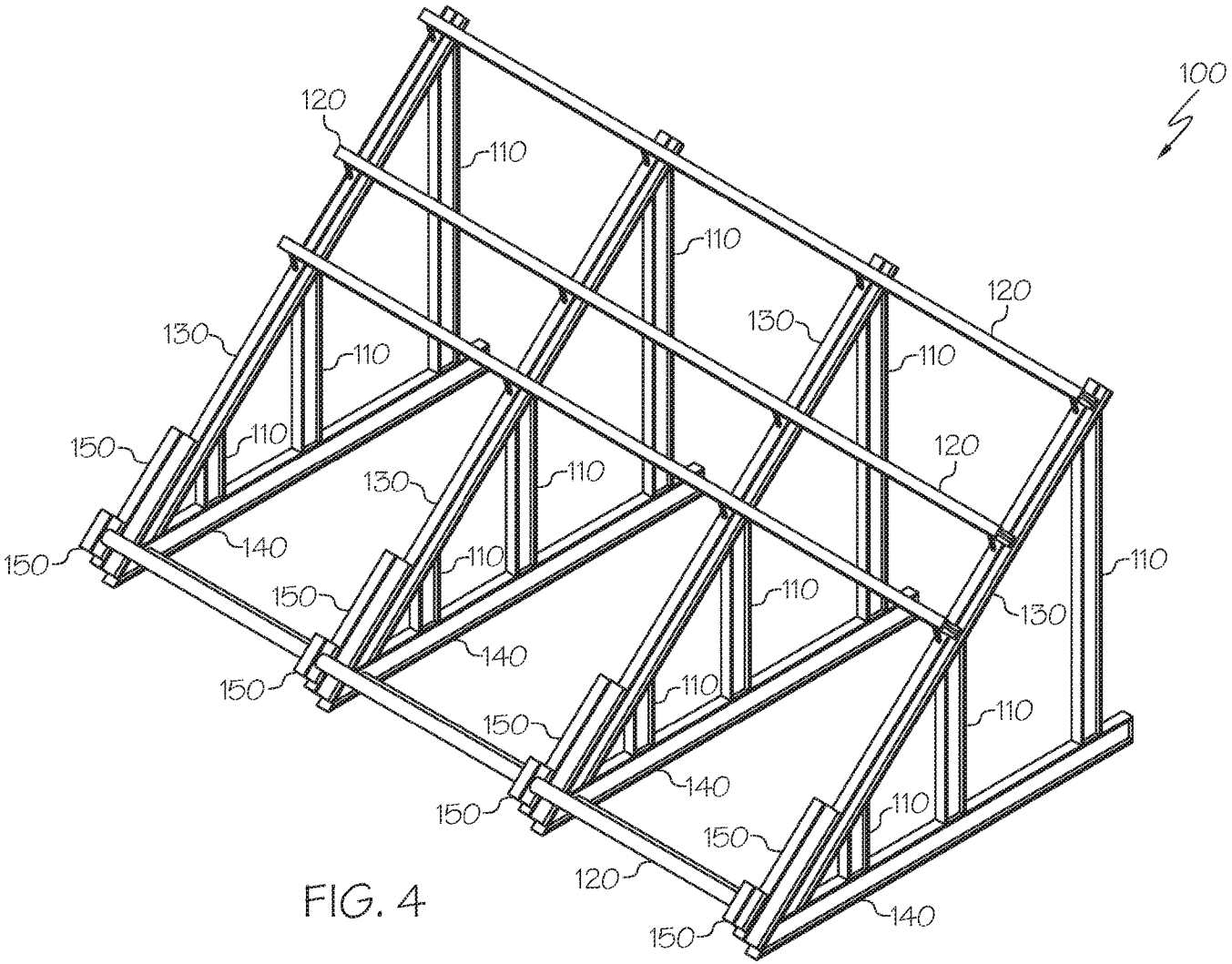
FIG. 4 is a perspective view of the portable assembly device of FIG. 1.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The invention generally relates to a barge system 10 that includes at least two barge section components 12 (shown in FIG. 5) that can be assembled using a crane 14 and a novel assembly device 100 (shown in FIGS. 1-4) to create a barge. The barge section components 12 may be manufactured and transported from a first location to a second location for assembly. The barge is unique in that, while conventional barges are manufactured as a single piece that makes transport by road and train difficult, the barge of this invention can be assembled from two or more section components 12. For this reason, many conventional barges must be assembled next to or near to a body of water. In many cases, land adjacent to a body of water is developed for purposes other than industrial use, is expensive, or is protected and unavailable for manufacturing purposes. The barge system 10 of this invention is advantageous in that the barge may be trucked in pieces to a temporary assembly site by the water.

The barge section components 12 include a first barge section component 12' and at least a second barge section component 12" that is attachable to the first barge section component to assemble a barge. Each of the barge section components 12 includes a watertight bulkhead compartment 12*a*, and each is sized so as to be capable of transportation by a truck or train from a first location to a second location where the barge is to be assembled using the portable assembly device 100. The first location can be a manufacturing facility that is or is not adjacent to a body of water. The second location can be a location that is adjacent to a body of water into which the barge can be lifted once it is assembled. The body of water is a navigable body of water such as a canal, a river, a lake, an estuary, a sound, a sea, or an ocean. The second location must have sufficient space to assemble the portable assembly device 100 and then to assemble the barge components 12 to create the barge before lifting the barge into the body of water.

Each of the barge section components 12 can include a central inner wall 16 that divides each barge section 12 into two watertight bulkhead compartments 12*a*. The first barge section component 12' and the at least second barge section component 12" are attached together using the portable assembly device 100. In some embodiments, the barge may include 3, 4, 5, 6, 7, 8, 9, 10, 11, 12, 13, 14, 15, or more barge section components 12 that are assembled to create the barge.

Once assembled, the barge supports a superstructure constructed on its top surface. In an exemplary embodiment, the superstructure can be a house so that the barge is used as a houseboat. In other embodiments, the barge may include living quarters, offices, a storage facility, a warehouse, governmental facilities, a school, a factory building or other work space, or any other suitable room, enclosure, or equipment that may be constructed or placed upon and used on a barge.

The portable assembly device 100 includes a structure having a series of various frame elements that are connected together. In exemplary embodiments, the structure is constructed from steel. The frame elements include a series of vertical support members 110, a series of horizontal members 120, a series of inclined members 130, and a series of base support members 140. Each frame element is a generally linear metal beam. The series of vertical support members 110 are connected to and support a corresponding set of inclined members 130 that are attached to the vertical support members. Bottom ends of the vertical support members 110 are connected each to one base support member of the series of base support members 140. The series of horizontal members 120 are attached to an outward facing surface of the inclined members 130 to create a surface against which the barge section components 12 can be rested. A shelf or stop member 150 is connected to a bottom outward facing surface of each inclined member 130.

The series of vertical support members 110 include at least two vertical support members. In one exemplary embodiment, the portable assembly device 100 includes four vertical support members 110. In other embodiments, the portable assembly device 100 may include 3, 5, 6, 7, 8, 9, 10, or more vertical support members 110.

In exemplary embodiments, the number of vertical support members 110 corresponds in number to the number of inclined members 130. For example, in exemplary embodiments that include four vertical support members 110, the portable assembly device 100 can also include four inclined members 130. One inclined member 130 is attached to each vertical support member 110, and each inclined member has an upper surface. In other embodiments, the number of vertical support members 110 may differ from the number of inclined members 130.

In one exemplary embodiment, the portable assembly device 100 includes nine vertical support members 110 so that at least three vertical support members are attached to each base support member 140 of the series of base support members, and the series of base support members includes three base support members. The series of vertical support members 110 are arranged in groups of at least three vertical support members that include a tall vertical support member 110*a*, an intermediate vertical support member 110*b*, and a short vertical support member 110*c*. Each short vertical support member 110*c* in each group of vertical support members 110 is about one-half the height of each intermediate vertical support member 110*b*, and each intermediate vertical support member 110*b* is about one-half the height of each tall vertical support member 110*a* in each group of vertical support members 110.

The series of inclined members 130 include at least three inclined members. Each inclined member 130 is attached in a sloping orientation with a highest portion of each inclined member being oriented toward a rear side of the portable assembly device 100 and a lowest portion of each inclined member being oriented toward a front side of the portable assembly device. For example, each inclined member 130 can be attached in a sloping orientation attached to top ends of a short vertical support member 110*c*, an intermediate vertical support member 110*b*, and a tall vertical support member 110*a* with the highest portion of the inclined member attached to the top end of the tall vertical support member and the lowest portion of the inclined member attached to the top end of the short vertical support member.

In some embodiments, at least one stabilizing member 160 is attached to the tall vertical support members 110*a* of the series of vertical support members 110 to provide additional stability to a rear side of the portable assembly device 100.

The series of horizontal members 120 includes at least two horizontal members. Each horizontal member 120 is attached to the upper surfaces of at least two of the inclined members 130 to create a support surface against which the first barge section component 12' and the at least second barge section component 12" can be rested. In exemplary embodiments, the portable assembly device 100 includes four horizontal members 120. In other embodiments, the portable assembly device 100 may include 2, 3, 5, 6, 7, 8, 9, 10, or more horizontal members 120.

The portable assembly device 100 also includes a series of base support members 140. Each vertical support member 110 is attached to a base support member 140 of the series of base support members. The vertical support members 110 are attached to a top surface of the respective base support members 140 to which each vertical support member is attached.

A bottom portion of each vertical support member 110 of the series of vertical support members is attached to a top surface of a base support member 140 of the series of base support members. A bottom surface of each inclined member 130 of the series of inclined members is attached to a top portion of a vertical support member 110 of the series of vertical support members, and a bottom surface of each horizontal member 120 of the series of horizontal members is attached to a top surface of at least two inclined members 130 of the series of inclined members.

The portable assembly device 100 further includes a stop member 150 connected to a bottom portion of the upper surface of at least one of the inclined members 130 to catch and hold in place a bottom surface of the first barge section component rested onto the support surface of the portable assembly device. The bottom surface of the first barge section component 12' that is rested on the support surface can be a side wall 12*b* or an end wall of the first barge section component that is oriented downward in contact with the stop member 150. In some embodiments, the portable assembly device 100 includes two stop members 150 that are each installed on a separate inclined member 130. In other embodiments, each inclined member 130 may have a stop member 150 installed thereon. In still other embodiments, the portable assembly device 100 may not include any stop members so that the bottom surface of the first barge section component 12' rests directly on a floor, ground, or other substrate.

The stop member 150 is constructed from metal, wood, rubber, plastic, or any other suitable material. In exemplary embodiments of the portable assembly device 100, the stop member 150 is constructed from steel.

The portable assembly device 100 may be assembled and disassembled as needed and when it is disassembled, the frame elements (i.e., its vertical support members 110, horizontal members 120, inclined members 130, and base support members 140) are separable for storage and transportation. In exemplary embodiments, the frame elements are welded together. In other embodiments, the frame elements can be connected together as described herein via bolts or any other suitable fastening means.

The portable assembly device 100 is constructed from steel, aluminum, a non-ferrous metal, a combination of two or more of the foregoing, or any other suitable material capable of supporting the weight of the barge section components.

The invention also relates to a barge assembly system 10. The barge assembly system 10 includes a portable assembly device 100 as described herein and a crane 14 as a means for lifting at least two barge section components 12 onto the portable assembly device for assembly of the barge. The crane 14 can be transported to and from the locations and by the transportation means that are described elsewhere herein.

The invention also relates to a method for assembling a barge. The method includes the step of building a first barge section component and at least a second barge section component at a first location. The first barge section component and the at least second barge section component then are transported to a second location. Next, the first barge section is lifted onto a support surface of a portable assembly device. The portable assembly device is one as described elsewhere herein. The at least second barge section component is lifted onto the support surface of the portable assembly device in a position that is superior to the first barge section component. The barge section components can be lifted by a crane that, together with the portable assembly device, form a barge assembly system. The first barge section component and the at least second barge section component are attached together to assemble a barge.

The portable assembly device may be assembled at the second location for use in assembling the barge. The step of assembling the portable assembly device may be completed before or after building one or more of the barge section components or before or after one or more of the barge section components are transported to the second location.

Figure 5:
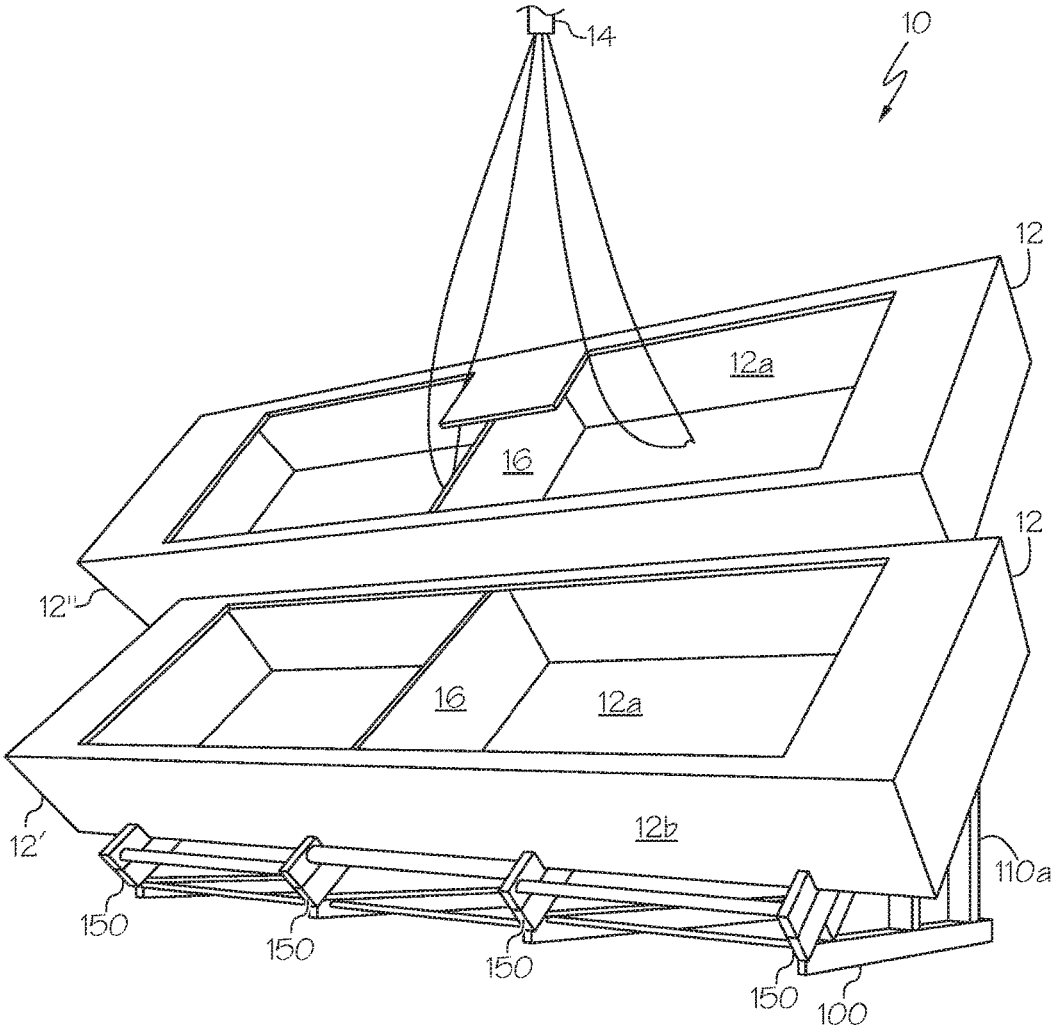
FIG. 5 is a perspective view of a first barge section component rested on a support surface of the portable assembly device of FIG. 1 and a crane lifting a second barge section component into a position adjacent and superior to the first barge section for assembly of the two barge section components into a barge.

As shown in FIG. 5, each barge section component can include four outer walls to form an open compartment that is bisected by a central inner wall. The four outer walls include opposing end walls and opposing side walls. The end walls can be shorter in length than the length of the side walls so that each barge section component is rectangular in a horizontal cross-section. The central inner wall divides the barge section into two watertight bulkhead compartments so that, when to barge section components are assembled, the barge has four watertight bulkhead compartments. The barge sections can be manufactured from lightweight materials such as aluminum although any suitable material from which a conventional vessel hull is manufactured can be used. Once connected together by welding or other means, the assembled barge provides a lightweight but rigid and strong platform that resists bending. In an exemplary embodiment, the barge section components may be connected together at wall of each section component that is aligned with a wall of the other section component. The connection may be completed using means that reduce structural noise related to thermal expansion and contraction. The barge may serve as a floating platform on and to which other structures (for example, a house boat) may be constructed and attached.

In one embodiment, an exterior of one wall of the assembled barge can include a dual universal motor mount.

The construction of the barge section components permits access to the keel for joining the section components together via welding (or other means) and for painting. The open compartments formed in the barge section components also maximize storage space for water tanks and permits access to plumbing and other necessary systems for the vessel structure that is constructed on and attached to the barge.

A crane is used to lift the first barge section component onto the assembly device so that a bottom surface of the first barge section component rests against the horizontal members and is retained in position by resting at an outer surface of one of its walls against the shelf members connected to each inclined member. The crane is then used to lift the second barge section component onto the assembly device so that its end walls and central wall are aligned linearly with the end walls and central wall of the first barge section component. When the two barge section components are so aligned, the process of permanently attaching them to one another by welding and/or other means can be commenced. Once the first and second barge section components are connected together, the assembled barge can be lifted by the crane off the assembly device and can be placed onto a horizontal dry surface or into the water for building of the structure that is to be constructed on an upper surface of the barge.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A barge system comprising a first barge section component and at least a second barge section component that is attachable to the first barge section component to assemble a barge, wherein each of the barge section components comprises a watertight bulkhead compartment; wherein the first barge section component and at least a second barge section component are attached together using a portable assembly device, wherein the portable assembly device comprises:

at least two vertical support members;

inclined members corresponding in number to the number of the at least two vertical support members, wherein one inclined member is attached to each vertical support member, and wherein each inclined member comprises an upper surface; and at least two horizontal members, wherein each horizontal member is attached to an upper surface of at least two of the inclined members to create a support surface against which the first barge section component and the at least second barge section component can be rested wherein the portable assembly device further comprises a stop member connected to a bottom portion of the upper surface of at least one of the inclined members to catch and hold in place a bottom surface of the first barge section component rested onto the support surface of the portable assembly device.

2. The barge system of claim 1, wherein each of the barge section components is sized so as to be capable of transportation from a first location to a second location where the barge is to be assembled using the portable assembly device.

3. The barge system of claim 1, wherein each of the barge section components comprises a central inner wall that divides each barge section into two watertight bulkhead compartments.

4. The barge system of claim 1, wherein after assembly, the barge supports a superstructure constructed on its top surface.

5. A barge assembly system comprising:

a portable assembly device for supporting at least two barge section components while they are attached together for assembly of a barge, wherein the portable assembly device comprises frame elements that are separable for storage and transportation wherein the frame elements of the portable assembly device comprise:

a series of base support members;

a series of vertical support members, wherein each vertical support member is attached to a base support member of the series of base support members;

a series of inclined members attached to the vertical support members, wherein each inclined member comprises an upper surface; and a series of horizontal members attached to the upper surfaces of the inclined members to create a support surface against which the at least two barge section components are rested for assembly of the barge;

wherein the series of vertical support members comprises at least nine vertical support members so that at least three vertical support members are attached to each base support member of the series of base support members, and wherein the series of base support members comprises at least three base support members.

6. The barge assembly system of claim 5, further comprising a stop member connected to a bottom portion of the upper surface of at least one of the inclined members to catch and hold in place a bottom surface of a first barge section component of the at least two barge section components that is rested onto the support surface of the portable assembly device.

7. The barge assembly system of claim 5, wherein the series of vertical support members are arranged in groups of at least three vertical support members comprising a tall vertical support member, an intermediate vertical support member, and a short vertical support member, wherein the short vertical support member in each group is about one-half the height of the intermediate vertical support member, and wherein the intermediate vertical support member is about one-half the height of the tall vertical support member.

8. The barge assembly system of claim 7, wherein at least one stabilizing member is attached to the tall vertical support members of the series of vertical support members to provide additional stability to a rear side of the portable assembly device.

9. The barge assembly system of claim 5, wherein the series of inclined members comprises at least three inclined members, wherein each inclined member is attached in a sloping orientation with a highest portion of each inclined member being oriented toward a rear side of the portable assembly device and a lowest portion of each inclined member being oriented toward a front side of the portable assembly device.

10. The barge assembly of claim 5, wherein a bottom portion of each vertical support member of the series of vertical support members is attached to a top surface of a base support member of the series of base support members, wherein a bottom surface of each inclined member of the series of inclined members is attached to a top portion of a vertical support member of the series of vertical support members, and wherein a bottom surface of each horizontal member of the series of horizontal members is attached to a top surface of at least two inclined members of the series of inclined members.

11. The barge assembly system of claim 5, further comprising a means for lifting at least two barge section components onto the portable assembly device for assembly of the barge.

12. The barge assembly system of claim 11, wherein the means for lifting comprises a crane for lifting the at least two barge section components onto the portable assembly device.

13. The barge assembly system of claim 5, wherein the portable assembly device is constructed from steel, aluminum, a non-ferrous metal, or a combination of two or more of the foregoing.

14. A method for assembling a barge comprising the steps of:

(a) building a first barge section component and at least a second barge section component at a first location;

(b) transporting the first barge section component and the at least second barge section component to a second location;

(c) lifting the first barge section onto a support surface of a portable assembly device, wherein the portable assembly device comprises:

a series of base support members;

a series of vertical support members, wherein each vertical support member is attached to a base support member of the series of base support members;

a series of inclined members attached to the vertical support members, wherein each inclined member comprises an upper surface; and a series of horizontal members attached to the upper surfaces of the inclined members to create the support surface against which the at least two barge section components are rested for assembly;

(d) lifting the at least second barge section component onto the support surface of the portable assembly device in a position that is superior to the first barge section component; and (e) attaching the first barge section component and the at least second barge section component together to assemble a barge.

15. The method of claim 14, wherein before steps (a), (b), or (c), the method comprises the step of assembling the portable assembly device at the second location for use in assembling the barge.

* * * * *